US011187011B2

(12) United States Patent
Kwon

(10) Patent No.: US 11,187,011 B2
(45) Date of Patent: Nov. 30, 2021

(54) DRIVING ASSEMBLY FOR A LEVER-TYPE DOOR LOCK

(71) Applicant: ASSA ABLOY Korea, Seoul (KR)

(72) Inventor: Tae Hoon Kwon, Bucheon-si (KR)

(73) Assignee: ASSA ABLOY KOREA, Seoul (KR)

( * ) Notice: Subject to any disclaimer, the term of this patent is extended or adjusted under 35 U.S.C. 154(b) by 324 days.

(21) Appl. No.: 16/369,290

(22) Filed: Mar. 29, 2019

(65) Prior Publication Data

US 2019/0301202 A1 Oct. 3, 2019

(30) Foreign Application Priority Data

Apr. 2, 2018 (KR) ..... 10-2018-0038270
Apr. 16, 2018 (KR) ..... 20-2018-0001680

(51) Int. Cl.
*E05B 47/00* (2006.01)
*E05B 47/02* (2006.01)
(Continued)

(52) U.S. Cl.
CPC ..... *E05B 47/0012* (2013.01); *E05B 15/101* (2013.01); *E05B 47/026* (2013.01);
(Continued)

(58) Field of Classification Search
CPC ..... E05B 47/0012; E05B 47/0692; E05B 47/026; E05B 15/101; E05B 65/0811; E05B 63/0056; E05B 2047/0067; E05B 2047/0031; E05B 2047/002; E05B 9/00; E05B 15/00
(Continued)

(56) References Cited

U.S. PATENT DOCUMENTS 5,542,274 A * 8/1996 Thordmark ..... E05B 47/063 70/495
6,227,020 B1 * 5/2001 Lerchner ..... E05B 47/063 70/278.3
(Continued)

FOREIGN PATENT DOCUMENTS

CN 201103285 Y 8/2008
EP 2 927 396 A1 10/2015
(Continued)

OTHER PUBLICATIONS

Office Action dated Jul. 3, 2020 issued in Chinese Application No. 201910260801.4 with English translation (17 pages).
(Continued)

*Primary Examiner* — Lloyd A Gall
(74) *Attorney, Agent, or Firm* — Nixon & Vanderhye P.C.

(57) ABSTRACT

Disclosed is a lever-type door lock driving assembly which can be installed inside a mounting hole to enable miniaturization of the device, ensure general versatility, and prevent a fragile area from being generated inside the door. The present invention relates to a driving assembly for a lever-type door lock arranged in an installation hole to drive a latch operating body, wherein the mounting assembly comprise a mounting module having a truncated disc shape and having at least one driving plate therein; and a motor unit mounted on the truncated area of the mounting module and having a disk shape in a state of being coupled to the mounting module.

12 Claims, 13 Drawing Sheets

(51) Int. Cl.

| | |
|---|---|
| ***E05B 47/06*** | (2006.01) |
| ***E05B 9/00*** | (2006.01) |
| ***E05B 15/10*** | (2006.01) |
| ***E05B 65/08*** | (2006.01) |
| *E05B 63/00* | (2006.01) |

(52) U.S. Cl.
CPC ..... *E05B 47/0692* (2013.01); *E05B 65/0811* (2013.01); *E05B 63/0056* (2013.01); *E05B 2047/002* (2013.01); *E05B 2047/0031* (2013.01); *E05B 2047/0067* (2013.01)

(58) Field of Classification Search
USPC ..... 70/277, 278.7, 279.1, 280–282; 292/144
See application file for complete search history.

(56) References Cited

U.S. PATENT DOCUMENTS

2011/0083482 A1* 4/2011 Goldman ..... E05B 47/0673 70/280
2014/0260449 A1* 9/2014 Uyeda ..... E05B 47/06 70/266
2015/0308157 A1* 10/2015 Lin ..... E05B 47/026 292/144
2015/0315818 A1 11/2015 Shen
2017/0211295 A1* 7/2017 Lin ..... E05B 47/0012
2017/0370127 A1* 12/2017 Huang ..... E05B 47/026
2019/0323263 A1* 10/2019 Kwon ..... E05B 1/003
2020/0032551 A1* 1/2020 Holmes ..... E05B 47/0692

FOREIGN PATENT DOCUMENTS

KR 10-0929435 B1 12/2009
KR 10-2016-0016983 2/2016

OTHER PUBLICATIONS

Extended European Search Report dated Aug. 16, 2019 issued in European Application No. 19166582.7 (10 pages).

* cited by examiner

【Fig 1】
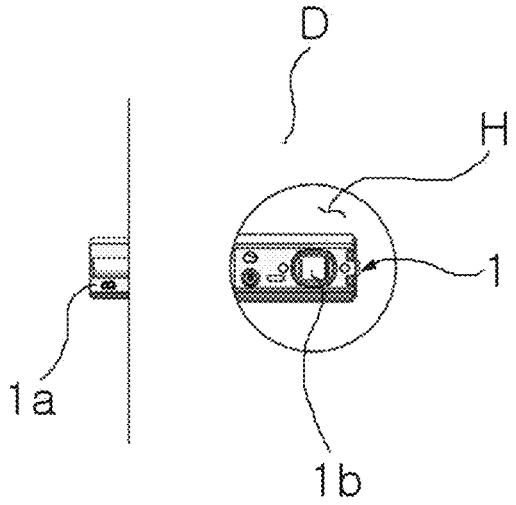
【Fig 2】
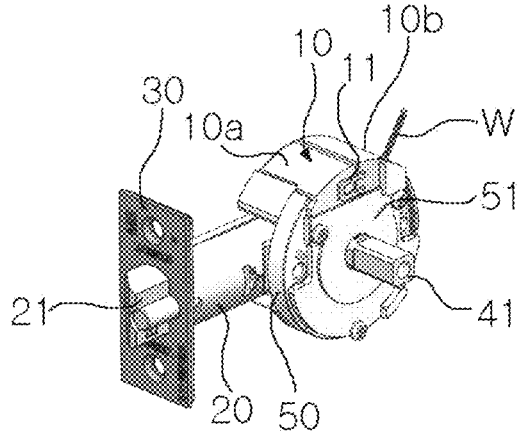

【Fig 3】
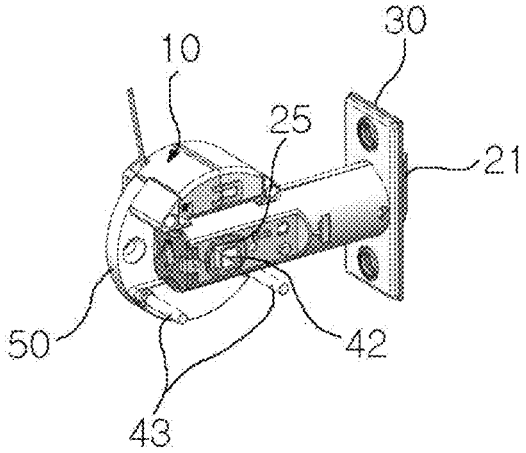
【Fig 4】
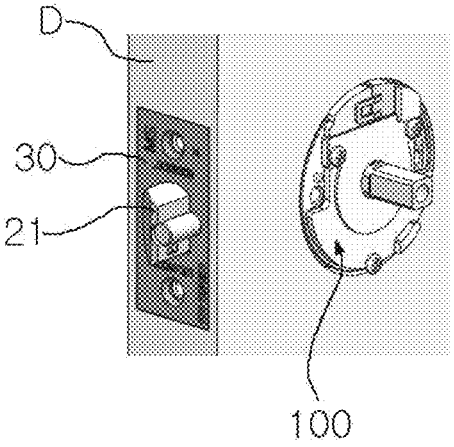

【Fig 5】
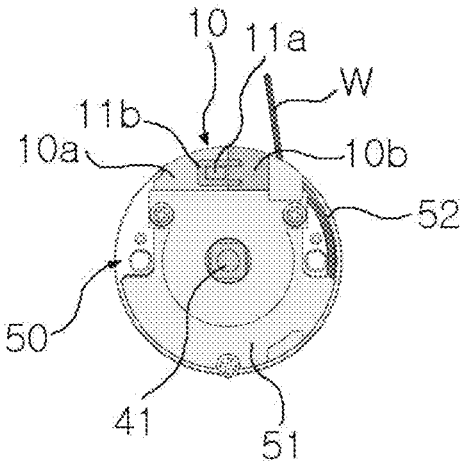
【Fig 6】
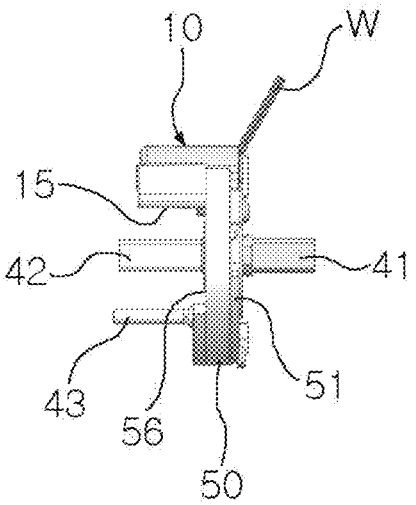

【Fig 7】
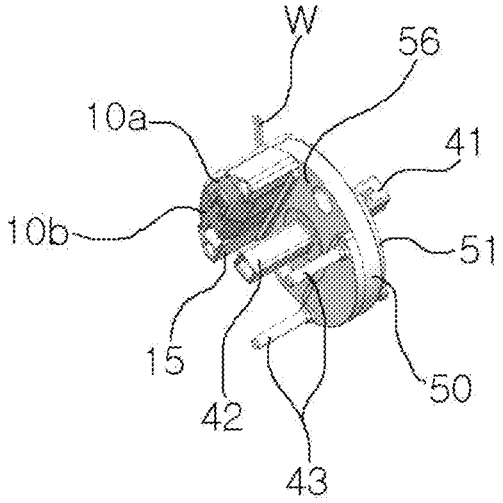
【Fig 8】
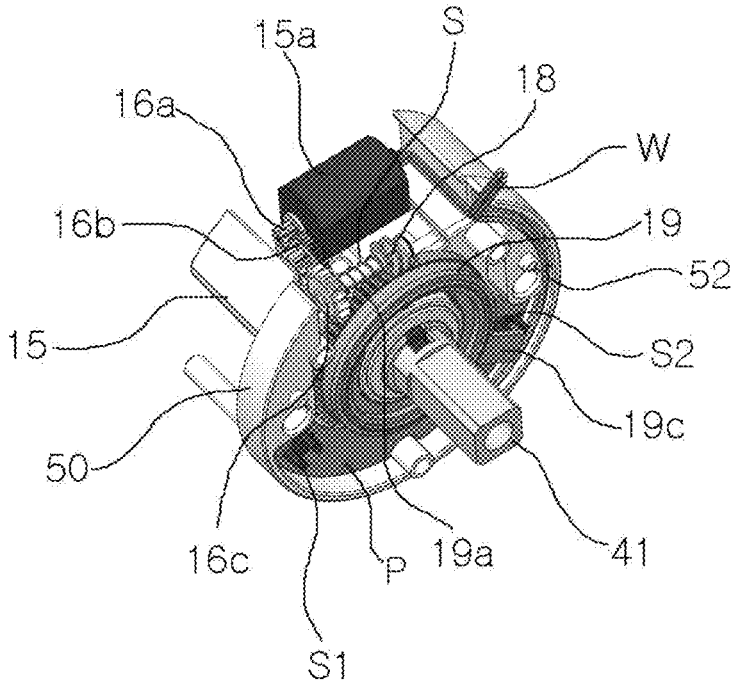

【Fig 9】
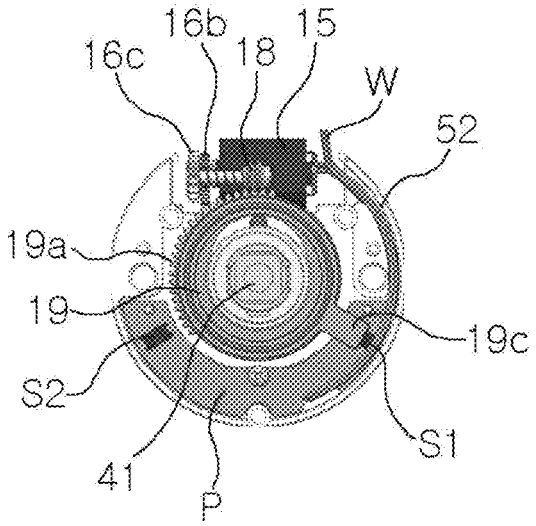
【Fig 10a】
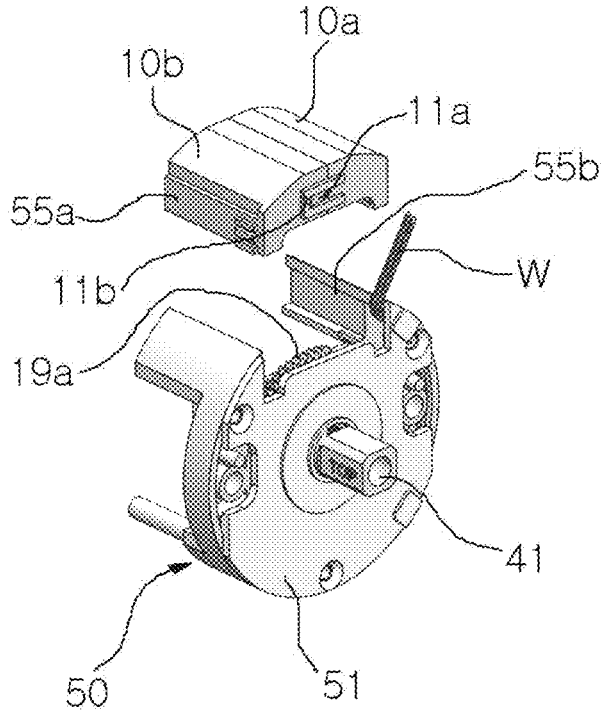

【Fig 10b】
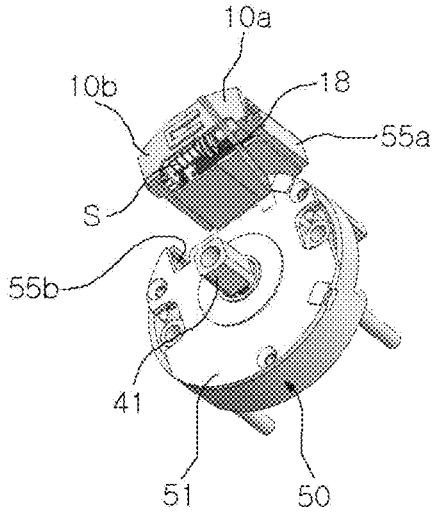
【Fig 11a】
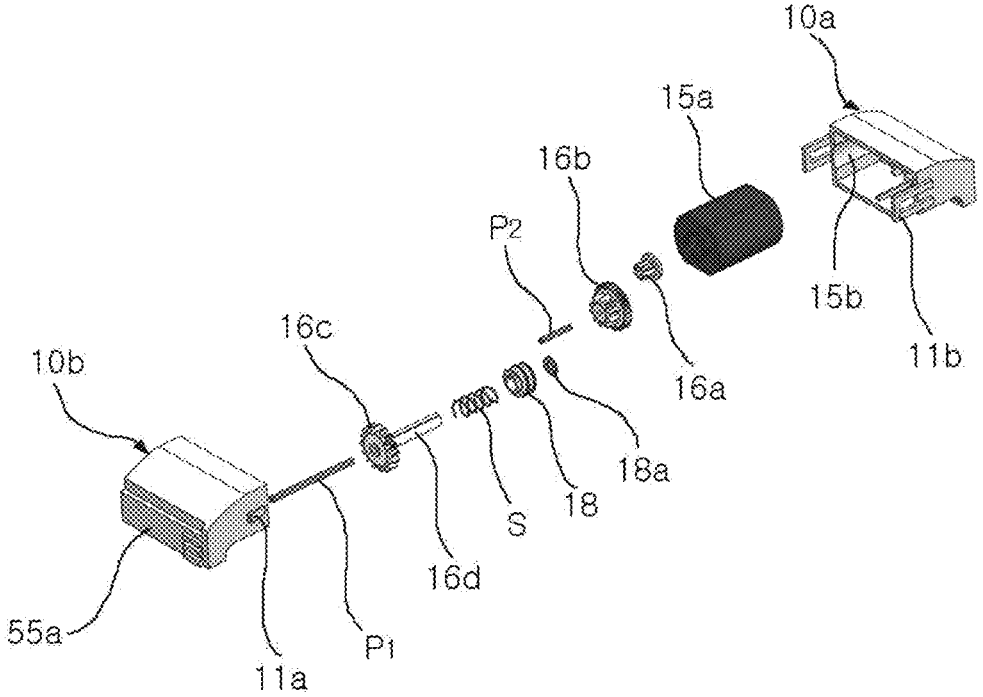

【Fig 11b】
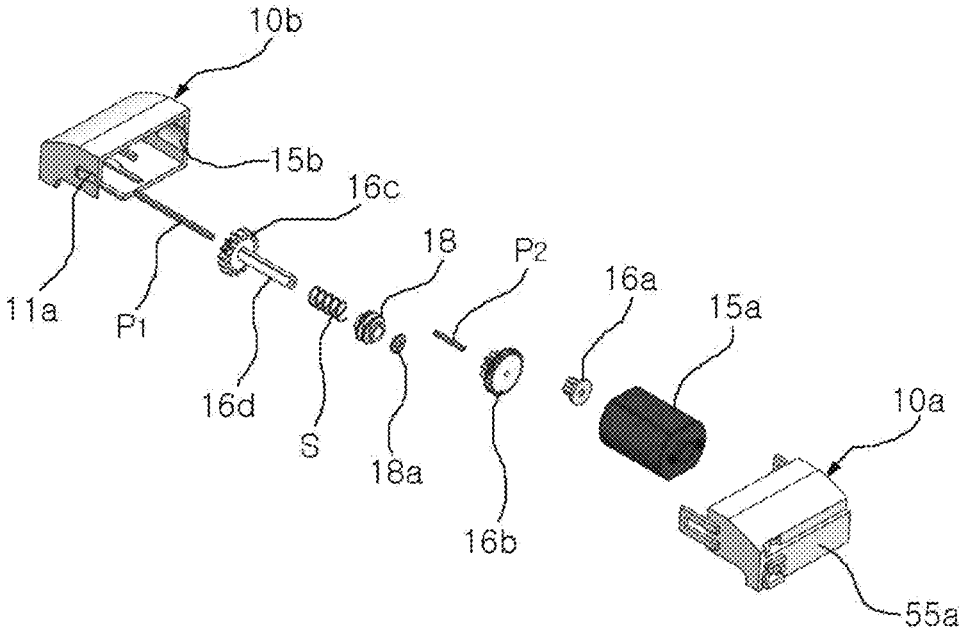
【Fig 12】
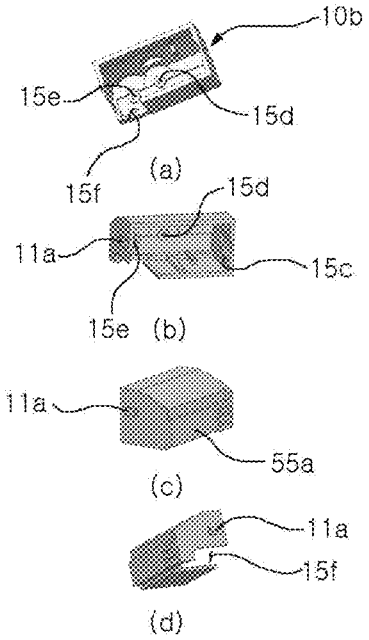

【Fig 13】
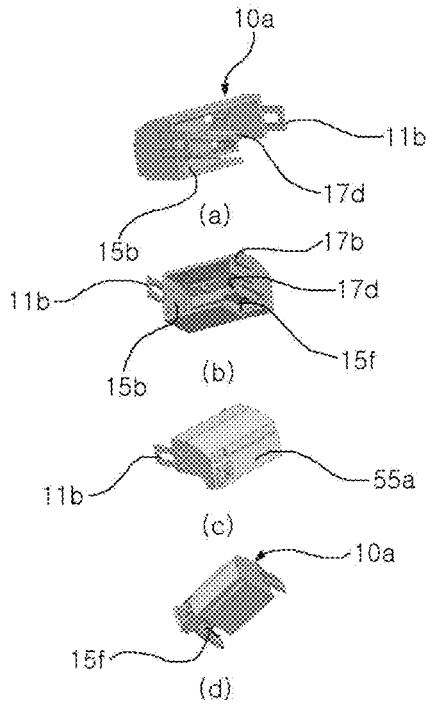
【Fig 14a】
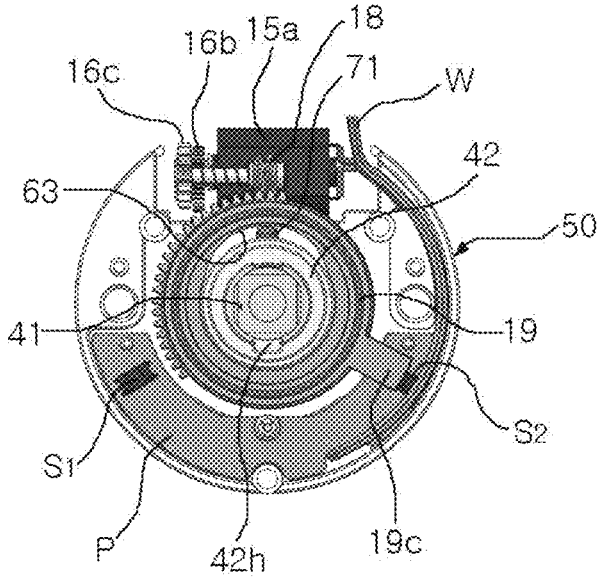

【Fig 14b】
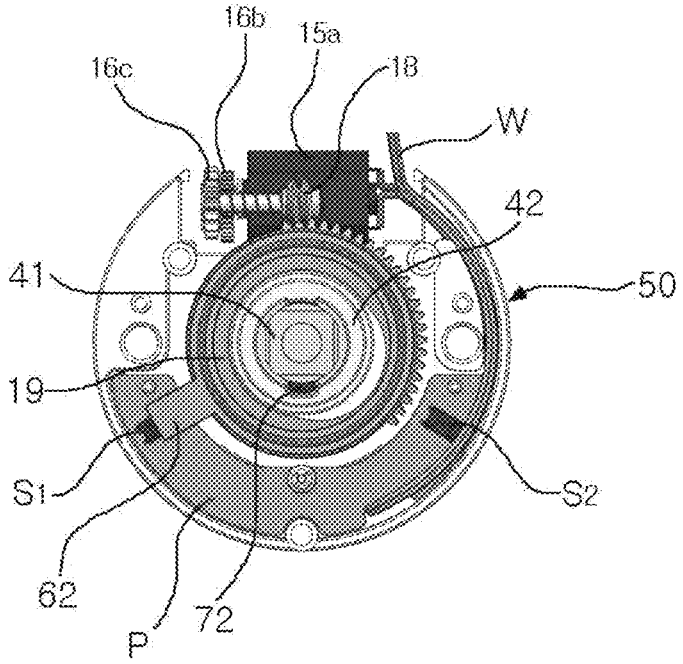
【Fig 15a】
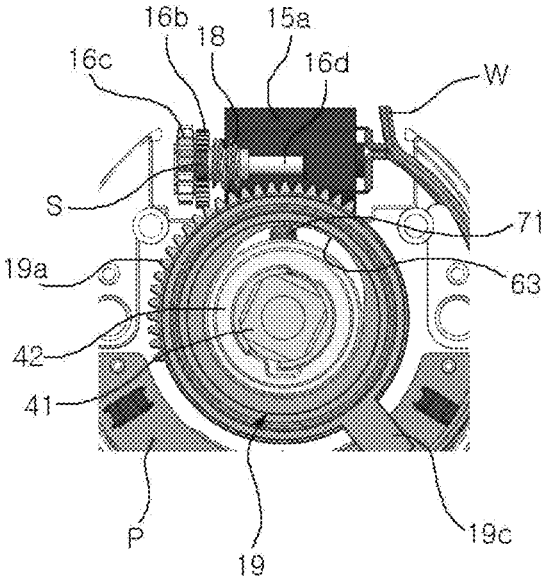

【Fig 15b】
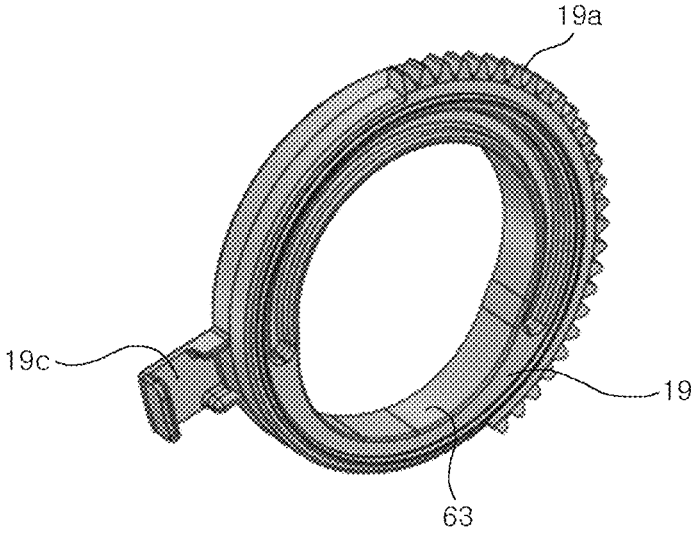

【Fig 16】
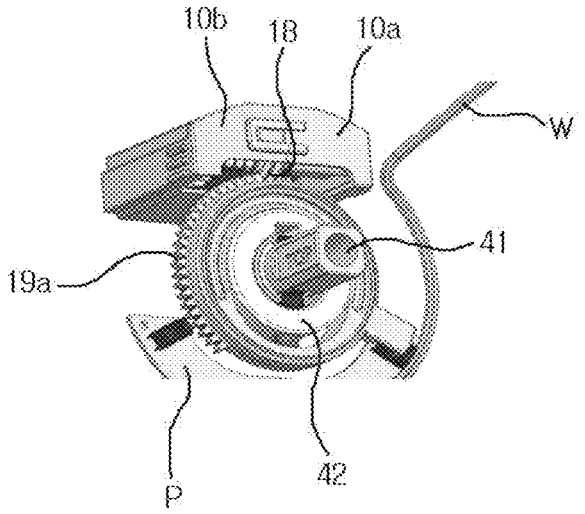
【Fig 17】
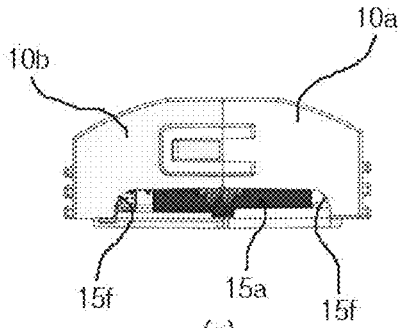
(a)
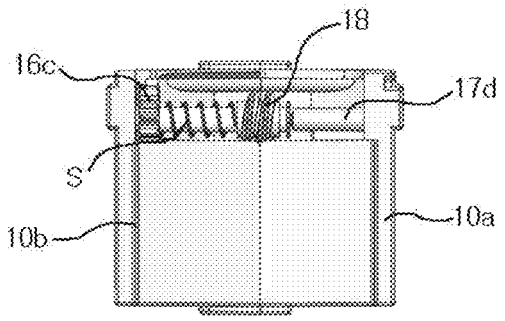
(b)

【Fig 18】
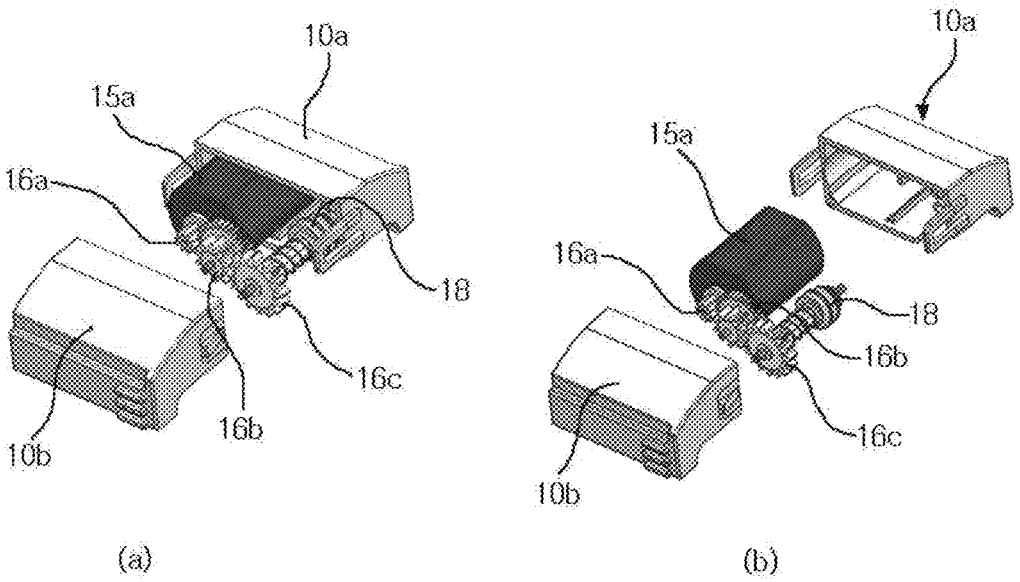
【Fig 19】
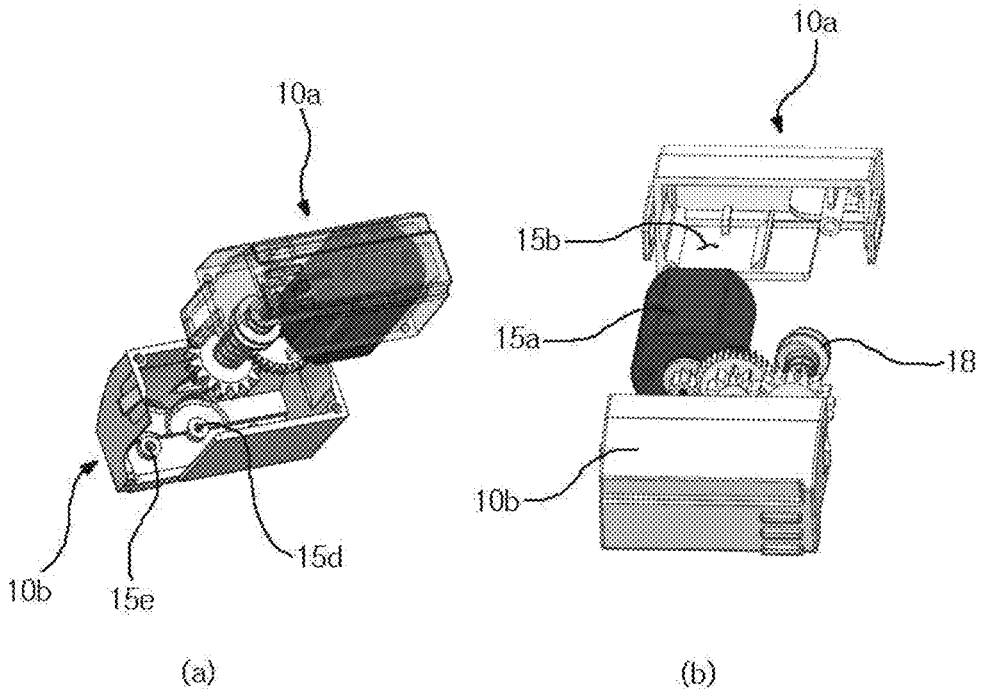

【Fig 20】
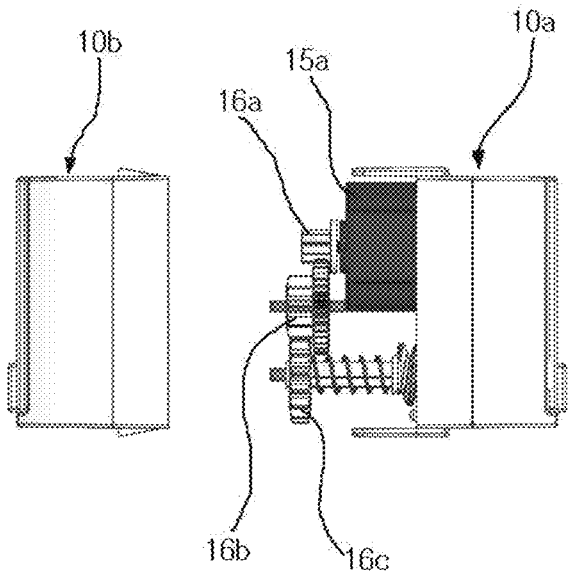
【Fig 21】
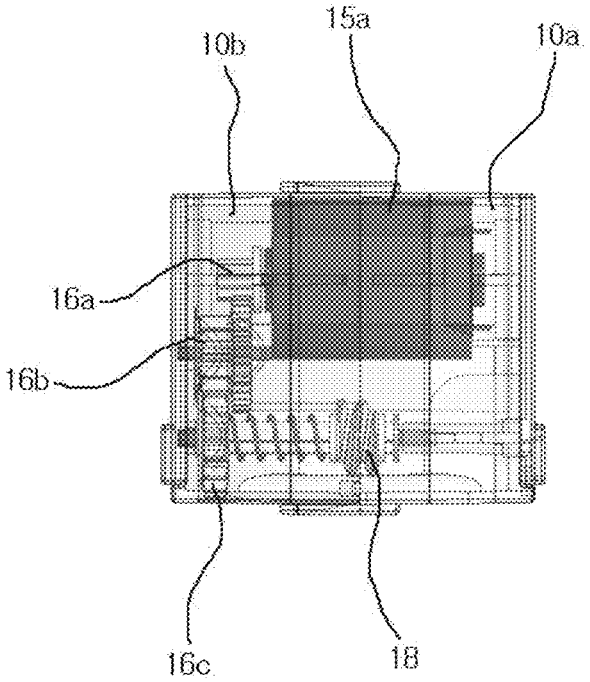

DRIVING ASSEMBLY FOR A LEVER-TYPE DOOR LOCK

This application claims priority to KR Patent Application No. 10-2018-0038270 filed 2 Apr. 2018, and KR Patent Application No. 20-2018-0001680 filed 16 Apr. 2018, the entire contents of each of which are hereby incorporated by reference.

BACKGROUND OF THE INVENTION

Field of the Invention

The present invention relates to a driving assembly for a lever-type door lock, and more particularly to a driving assembly for a lever-type door lock mounted in an installation hole.

Description of the Prior Art

Generally, a lever-type door lock device is a device in which a dead bolt or a latch bolt is driven by turning one of an indoor-side lever and an outdoor-side lever to set and release a lock.

Such a lever-type door lock device includes a door lock capable of locking and unlocking the door only on the indoor side and a door lock capable of locking and unlocking the door on the indoor and outdoor side.

FIG. 1 is a state diagram showing the installation state of a conventional lever-type door lock device.

Referring to FIG. 1, in the conventional lever-type door lock device, an installation hole H of approximately 54 mm in diameter is made by drilling the door D, and a latch operating body 1 is mounted in the an installation hole H. At this time, a mounting hole 1*b* into which a drive shaft (not shown) for driving the latch bolt 1*a* is inserted is formed at an end of the latch operating body 1.

However, in such a conventional lever-type door lock device, the remaining space of the mounting hole except for a part of the latch operating body 1 becomes left as an unnecessary space (empty space). This causes a problem of lowering the durability of a door D.

Further, in the conventional lever-type door lock device, since the connecting body for connecting the latch operating body 1 to an external driving unit is provided outside the door D, it is difficult to miniaturize the apparatus. Further, since a driving unit is generally manufactured in a part of a door lock (dedicated to product model), the driving unit is different according to a door lock product, and the driving unit is not compatible with each other. This causes a problem of reducing general application.

<Prior Art 1> Korean Patent Publication No. 2016-0016983 (published on: 15 Feb. 2016)

SUMMARY OF THE INVENTION

It is an object of the present invention to provide a lever-type door lock driving assembly which is designed to solve the above-mentioned problems and which is capable of downsizing the apparatus and securing versatility.

To achieve the object, according to an aspect of the present invention, there is provided a driving assembly for a lever-type door lock which is disposed in an installation hole to drive a latch operating body, wherein the driving assembly includes a mounting module formed in a truncated disc shape and having at least one driving plate therein, and a motor unit mounted on the truncated area of the mounting module and having a disk shape in a state of being coupled with the mounting module.

The motor unit may include: a driving motor; and a gear portion for transmitting a driving force of the driving motor to the driving plate.

At least one shaft may be pierced to be connected to the mounting module, and an outer toothed gear connected to the gear portion may be formed on a part of an circumferential surface of the driving plate.

The gear portion may include a plurality of reduction gears, wherein one gear of the reduction gears connected to the outer toothed gear of the driving plate is a worm gear, and the worm gear is elastically supported by a spring on a rotary shaft of the other reduction gear.

On the inner circumferential surface of the mounting module a guide channel may be formed for guiding a wire connected to PCB.

According to another aspect of the present invention, there is provided a driving assembly for a lever-type door lock arranged in an installation hole to drive a latch operating body, wherein the mounting assembly includes: a mounting module formed in a truncated disc shape and having at least one driving plate therein; and a case detachably installed in a part of the mounting module and having a driving motor and at least one gear portion therein.

An opening may be formed in a part of the case, and at least a part of the gear part may be exposed through the opening so as to be connected to the driving plate.

A first case and a second case of the case may be detachably coupled to each other.

At least one latching hook may be formed on the outer surface of the first case and at least one latching hook may be formed on the outer surface of the second case.

The gear portion may include at least one reduction gear and a dependent gear for gear-connecting to the driving plate.

The gear portion may include a connection release member for releasing a gear connection between the driving plate and the dependent gear.

The connection release member may include: a rotary shaft extending in one direction of the dependent gear; a spring inserted into the rotary shaft; and a worm gear elastically supported by the spring and mounted to an end of the rotary shaft.

According to the present invention, since an empty space of the installation hole can be utilized as an installation space of the driving unit, the device can be downsized as a whole. Also, since a space for installing the driving unit outside the door is not required, it is possible to avoid restrictions on the product design.

In addition, according to the present invention, since the driving assembly is embedded in an empty space of the installation hole, a fragile area can be prevented from being formed at the door, and the driving assembly can be directly connected to the latch operating body. Therefore, this invention can be applied to various conventional lever-type door lock products, thereby increasing the versatility.

BRIEF DESCRIPTION OF THE DRAWINGS

FIG. 1 is a drawing showing an installation state of a conventional lever-type door lock device, FIG. 2 is a perspective view of a state in which a driving assembly for a lever-type door lock according to a first embodiment of the present invention is connected to a latch operating body, FIG. 3 is a perspective view of FIG. 2 from another angle, FIG. 4 is an installation view of a driving assembly for a lever-type door lock according to the first embodiment of the present invention, FIG. 5 is a front view of a driving assembly for a lever-type door lock according to the first embodiment of the present invention, FIG. 6 is a side view of a driving assembly for a lever-type door lock according to the first embodiment of the present invention, FIG. 7 is a perspective view showing a rear side of a driving assembly for a lever-type door lock according to the first embodiment of the present invention, FIG. 8 is a drawing showing an internal configuration of a driving assembly for a lever-type door lock according to the first embodiment of the present invention;

FIG. 9 is an internal structural view of a driving assembly for a lever-type door lock according to the first embodiment of the present invention, FIGS. 10A and 10B are drawings showing the mounting of a modulated motor unit of a driving assembly for a lever-type door lock according to the first embodiment of the present invention;

FIGS. 11A and 11B are exploded perspective views of a driving module assembly for a door lock according to a second embodiment of the present invention, FIG. 12 is a perspective view from various angle of the second case of the door lock module according to the second embodiment of the present invention, FIG. 13 is a perspective view from various angles of the first case of the door lock drive module assembly according to the second embodiment of the present invention, FIGS. 14A and 14B are drawings showing the operation of a driving module assembly for a door lock according to a second embodiment of the present invention, FIGS. 15 A and 15B are drawings showing the operation of a connection release member of a driving module assembly for a door lock according to the second embodiment of the present invention, FIGS. 16 to 21 are drawings showing a driving module assembly from various angles for a door lock according to the second embodiment of the present invention.

DETAILED DESCRIPTION OF THE EXEMPLARY EMBODIMENTS

Hereinafter, the present invention will be described in more detail with reference to the accompanying drawings. Terms and words used in the present specification and claims should not be interpreted as limited to ordinary or dictionary terms, but should be interpreted in a meaning understood by a person having ordinary skill in the art to which this invention belongs. In the following description and the accompanying drawings, descriptions of known functions and configurations that may unnecessarily obscure the subject matter of the present invention will be omitted. The accompanying drawings are provided by way of example so that those skilled in the art can fully understand the spirit of the present invention. Therefore, the present invention may be embodied in other forms not limited to the following drawings. In addition, like reference numerals designate like elements throughout the specification.

Embodiment 1

Referring to FIGS. 2 to 4, a driving assembly 100 (FIG. 4) is directly connected to a latch operating body 20. In this case, a circular installation hole H (FIG. 1) of about 54 mm in diameter is formed in the door D. The driving assembly 100 is mounted in the installation hole H.

At this time, the driving assembly 100 has a shape and an area corresponding to the installation hole H and is fitted into the installation hole H.

Specifically, the latch operating body 20 is installed so that a latch bolt 21 can be drawn out at the tip of the latch operating body 20. Further, a mounting plate 30 is fitted into the tip end of the latch operating body 20. The mounting plate 30 is fixed to the side surface of the door D as shown in FIG. 4. On the other hand, the latch operating body 20 is provided with a pivot portion 25 (FIG. 3) for pulling out the latch bolt 21 by rotation. A second shaft 42 of the driving assembly 100 is fitted into the pivot portion 25.

The driving assembly 100 includes a motor unit 10 mounted on the upper part and a mounting module 50 mounted on the lower part. At this time, a cover plate 51 is mounted in front of the mounting module 50. The motor unit 10 is configured such that a first case 10*a* and a second case 10*b* are coupled to each other by a fastening means 11, and the upper surface of the motor unit 10 forms a gentle curved surface in conformity with the inner circumferential surface of the installation hole H (FIG. 1) of the door D.

The mounting module 50 is provided with a pair of fixing posts 43. The fixing post 43 is fastened to a handle shaft cover (not shown) and serves to fix the driving assembly 100 to the inside of the door D (into the installation hole). On the other hand, the mounting module 50 has a round outer circumferential surface so as to have a circular shape as a whole in a state where the motor unit 10 is mounted on the upper portion thereof. That is, the mounting module 50 has a shape corresponding to the installation hole H of the door D.

On the other hand, when the latch operating body 20 is mounted on the driving assembly 100, the second shaft 42 of the driving assembly 100 is fitted into the pivot portion 25 of the latch operating body 20. Accordingly, the second shaft 42 is rotated by the driving of the motor unit 10 and the pivot portion 25 is rotated by this rotational force so that the latch bolt 21 may be pulled in or pulled out.

Referring to FIGS. 5 to 7, a motor unit 10 is mounted on the top of a circular mounting module 50. At this time, the motor unit 10 is provided with a driving motor 15*a* and a gear portion 16*a*, 16*c* and 18 inside it and protects them inside cases 10*a* and 10*b*(See FIG. 8). At this time a hook protrusion 11*a* is fastened to a latching end 11*b* to fix the cases 10*a* and 10*b*. A guide channel 52 is formed in the mounting module 50. The guide channel 52 contains electric wire W along the rim of the mounting module 50.

On the other hand, the mounting module 50 is provided with a mounting groove 56 in which the latch operating body 20 is placed laterally. A second shaft 42 pierces the center of the mounting groove 56 and a fixing portion 15 is formed at an upper side of the mounting groove 56. At this time, a motor unit 10 is mounted at the center of the fixing portion 15 (see FIG. 6). The fixing portion 15 is an area where it is in a close contact with the outer circumferential surface of the latch operating body 20 when the latch operating body 20 is mounted. The fixing portion 15 prevents the latch operating body 20 from shaking after the mounting thereof. That is, the mounting groove 56 is provided in a type of a concave groove formed in the mounting module 50 in a horizontal direction so as to serve as a fixing surface for supporting the upper and lower surfaces of the latch operating body 20.

Also a cover plate 51 is mounted in front of the mounting module 50. A first shaft 41 is provided at the center of the cover plate 51. Here, the first shaft 41 is coaxially connected to a second shaft 42, and they may be connected to each other by a clutch mechanism to be clutch engaged or disengaged.

Referring to FIG. 8, a driving plate 19 is formed inside a mounting module 50, in which a first shaft 41 and a second shaft 42 rotate in a clutch engagement state or rotate alone, and the outer toothed gear 19*a* is formed on a part of the outer circumferential surface of the driving plate 19. On the other hand, a driving motor 15*a* is installed on the upper portion of the mounting module 50. A first gear 16*a* is provided on the output shaft of the driving motor 15*a*. The first gear 16*a* is decelerated through a second gear 16*b* and a third gear 16*c* and drives a worm gear 18 with the decelerated rotational force. When the worm gear 18 is driven at such a constant reduction ratio, an outer toothed gear 19*a* gear-connected to the worm gear 18 is moved to rotate the driving plate 19.

When the driving plate 19 is rotated as described above, the first shaft 41 and the second shaft 42 are clutch engaged with each other to rotate together and then a pivot portion 25 connected to the first shaft 41 or the second shaft 42 as shown in FIG. 3 can be rotated, whereby a latch bolt 21 may be pulled in or pulled out from a latch operating body 20.

At this time, a spring S is mounted on the rotating shaft of the third gear 16*c*, and the worm gear 18 is elastically supported by the spring S. Since the spring S is mounted on the rotation shaft of the third gear 16*c*, it is possible to prevent the reaction force generated when the driving plate 19 is rotationally driven in the clutch engagement state of a handle shaft from being transmitted to the drive motor 15*a*.

Also, a PCB P is mounted inside the mounting module 50 and a plurality of sensors S1 and S2 are mounted on the PCB P. In addition, the driving plate 19 is provided with a sensing piece 19*c* extending in one direction so that when the drive plate 19 is rotated the sensing piece 19*c* is rotated together with it. Therefore, the rotation of the sensing piece 19*c* may be sensed through the first sensor S1 and the second sensor S2, whereby the pull-out state (the locked state) or the pull-in state (the unlocked state) of the latch bolt 21 may be sensed.

Referring to FIGS. 10A and 10B, a first case 10*a* and a second case 10*b* are fastened to each other in a motor unit 10, and a mounting projection portion 55*a* is formed on the side surfaces of the cases 10*a* and 10*b*. The mounting protrusion portion 55*a* of the cases 10*a* and 10*b* may be easily installed by being fitted into the inner grooves 55*b* formed in the upper opening area of the mounting module 50 in a state where the mounting protrusion portion 55*a* is coupled to the cases 10*a* and 10*b*. Therefore, in the present invention, the motor unit 10 can be installed on the mounting module 50 with ease.

According to the present invention having the above-described structure, a driving assembly 100 is disposed in an installation hole H of the door D perforated when a lever-type door lock is installed, and a latch bolt (21) of a latch operating body 20 may be pulled in or pulled out by the driving force of the driving assembly 100.

Accordingly, an empty space of the installation hole H formed in the door D can be utilized as a space for installation, thereby making it possible to miniaturize the apparatus. In addition, since it is not necessary to install a separate driving portion outside the door D, a free product design is possible. By forming the driving assembly 100 in the empty space of the installation hole H, it is possible to prevent a fragile area from being made on the door D.

Also, since the driving assembly 100 may be directly connected to the latch operating body 20, this invention can be applied to various conventional lever-type door locks, thereby improving versatility.

Embodiment 2

According to FIGS. 11A and 11B, a case is formed by coupling a first case 10*a* and a second case 10*b* to each other. A plurality of gears and a drive motor 15*a* are installed in these cases 10*a* and 10*b*.

Specifically, a motor mounting portion 15*b* having a predetermined space is provided in the first case 10*a* (see FIGS. 19 and 20). The drive motor 15*a* is contained in the motor mounting portion 15*b* of the first case 10*a*. A motor gear 16*a* is mounted on a drive shaft of the drive motor 15*a* and the motor gear 16*a* is connected to mesh with to an intermediate gear 16*b*. At this time, the intermediate gear 16*b* is rotatably mounted inside the case through a second pin P2. The intermediate gear 16*b* is connected to mesh with the dependent gear 16*c*. At this time, the dependent gear 16*c* has a rotation axis 16*d* extending to one side, and a worm gear 18 is mounted at the end of the rotation axis 16*d* with a spring S mounted on the rotation axis 16*d*. At this time, the worm gear 18 is provided at the distal end of the rotation axis 16*d* so as not to be separated through a fixing ring 18*a*, and a spline is formed on the rotation axis 16*d* so that the worm gear 18 is rotated together with the dependent gear 16*c*. Here, the dependent gear 16*c* is rotatable inside the cases 10*a*, 10*b* through a first pin P1.

Meanwhile, snap-on or various other fastening methods can be applied to the first case 10*a* and the second case 10*b* for easy disassembly and assembly. For example, as shown in FIGS. 11A and 11B, an annular engaging end 11*b* is formed on the front and rear surfaces of the first case 10*a*, and a latching hook 11*a* is formed on the front and rear surfaces of the second case 10*b* so that the latching hook 11*a* is fastened to the engaging end 11*b*. Accordingly, the first case 10*a* and the second case 10*b* are coupled to each other by fastening the latching hook 11*a* to the fastening end 11*b*.

The internal configuration of a case 10*a* and a second case 10*b* will be described with reference to FIGS. 12 and 13. Referring to FIG. 12, a first mounting groove 15*e* and a second mounting groove 15*d* into which the ends of a first pin P1 and a second pin P2 are respectively inserted are formed inside the second case 10*b*, (See FIG. 11*b*), and a motor mounting portion 15*b* into which a drive motor 15*a* is inserted is formed inside the first case 10*a* (see FIG. 11*b*). That is, the motor mounting portion 15*b* is formed in the first case 10*a*, and the first mounting groove 15*e* and the second mounting groove 15*d* are formed in the second case 10*b* for fixing gear shafts. An opening 15*f* is formed at the bottom of the space formed in the first mounting groove 15*e*. At this time, a dependent gear 16*c* and a worm gear 18 are exposed through the opening 15*f*, In particular, the worm gear 18 is gear-connected to a driving plate 19 of the mounting module 50 to rotate the driving plate 19.

Meanwhile, the shafts of a dependent gear 16*c*, the intermediate gear 16*b* and a motor gear 16*a* are arranged in parallel in the first case 10*a* and the second case 10*b*, respectively (See FIGS. 20 and 21).

Next, referring to FIG. 13, a latching end 11*b* is formed on both sides of a first case 10*a* and fastened to a latching hook 11*a* of a second case 10*b*. A motor mounting portion 15*b* is provided in the first case 10*a* and a mounting boss 17*d* to which a first pin P1 (FIG. 11*b*) is mounted is provided. Accordingly, the first pin P1 is fixed at both ends between the first case 10*a* and the second case 10*b* and through the first pin P1, a dependent gear 16*c* and a worm gear 18 connected to a rotation axis 16*d* of the dependent gear 16*c* may be rotated (See FIG. 11*b*). An opening 15*f* is formed in the second case 10*b* as well as the first case 10*a*. A mounting end 55*a* is formed on the outer side of the second case 10*b* as well as the first case 10*a* so as to be mounted on a mounting channel 55*b* (FIG. 10*b*) of a mounting module 50.

Referring to FIGS. 14A, 14B, 16, and 17, a dependent gear 16*c* is connected to the plurality of reduction gears and is rotated at a constant reduction ratio by a drive motor 15*a*. A driving plate 19 is rotated by rotating a worm gear 18 with the rotational force.

When the driving plate 19 is rotated as described above, then a cam surface 63 is moved and, by the movement of the cam surface 63 a pin member 71 abutting against the cam surface 63 is pressed, which causes the pin member 71 to pierce a first shaft 41 and a second shaft 42. And a distal end 72 of the pin member 71 is inserted into an internal connection groove 42*h* to achieve clutch engagement state. Therefore, the first shaft 41 is connected to a second shaft 42 and synchronized with the second shaft 42 to drive a latch assembly 20, thereby enabling a latch bolt 21 to be pulled in or pulled out.

In the present invention, a worm gear 18 connected to a dependent gear 16*c* drives a driving plate 19. However, the dependent gear 16*c* may directly drive the driving plate 19.

According to the present invention, a first case 10*a* and a second case 10*b* are coupled to each other at the upper portion of a mounting module 50, and reduction gears and a driving motor 15*a* are installed inside the first case 10*a* and the second case 10*b*, thereby enhancing a miniaturized module structure. At this time, since the upper surfaces of the first case 10*a* and the second case 10*b* are formed to be convex, they become circular when the cases 10*a* and 10*b* are combined with the mounting module 50. Therefore, the mounting module 50 may be installed to fit the installation hole H (FIG. 1) which is generally formed in a circular shape. Further, the cases 10*a* and 10*b* may be mounted on various door lock driving components as a modular structure for the mounting module 50 so that a driving force of the driving motor 15*a* may be provided to door lock driving components, thereby enhancing versatility.

On the other hand, referring to FIG. 15, in conventional door locks, a driving plate 19 is sometimes stopped during operation as a the latch bolt or a dead bolt is caught in operation.

That is, when a drive motor 15*a* rotates while the driving plate 19 is caught during operation, a reaction force acts to damage the drive motor 15 and the gears connected thereto. To prevent this, a connection release member is provided in the present invention.

Specifically, when the driving plate 19 is stopped during operation as shown in FIG. 15, a rotational force transmitted through a dependent gear 16*c* rotates a worm gear 18, but the driving plate 19 is not rotated because it is in a caught condition. At this time, the worm gear 18 continues to rotate on a rotary shaft 16*d* and moves to the left along an outer toothed gear 19*a* of the driving plate 19 while overcoming an elastic force of a spring S. Eventually, the worm gear 18 is disengaged from the outer toothed gear 19*a* at the end point of the outer toothed gear 19*a*.

Accordingly, it is possible to prevent the reaction force generated by the drive motor 15*a* being continuously driven in a caught state of the driving plate 19 from being transmitted to the drive motor 15*a* through a gear portion, thereby preventing a damage to the gear portion and the drive motor 15*a*.

While the present invention has been particularly shown and described with reference to the particular embodiments thereof, it is to be understood that the invention is not limited to the disclosed embodiments, but, on the contrary, It will be understood by those skilled in the art that various changes in form and details may be made therein without departing from the spirit and scope of the invention.

What is claimed is:

1. A driving assembly for a lever-type door lock arranged in an installation hole to drive a latch operating body, comprising a mounting module formed in a truncated disc shape and having at least one driving plate therein; and a motor unit mounted on the truncated area of the mounting module and having a disk shape in a state of being coupled with the mounting module.

2. The driving assembly according to claim 1, wherein the motor unit comprises:

a drive motor; and a gear portion for transmitting a driving force of the driving motor to the driving plate.

3. The driving assembly according to claim 2, wherein at least one shaft is pierced to be connected to the mounting module, and an outer gear toothed coupled to the gear portion is formed on a part of an outer circumferential surface of the driving plate.

4. The driving assembly according to claim 3, wherein the gear portion comprises a plurality of reduction gears, one gear of the reduction gears connected to the outer toothed gear of the driving plate is a worm gear, and the worm gear is elastically supported by a spring on a rotary shaft of the other reduction gear.

5. The driving assembly according to claim 1, wherein on the inner circumferential surface of the mounting module a guide channel is formed for guiding a wire connected to PCB.

6. The driving assembly for a lever-type door lock arranged in an installation hole to drive a latch operating body, comprising a mounting module formed in a truncated disc shape and having at least one driving plate therein; and a case detachably installed in a part of the mounting module and having a driving motor and at least one gear portion therein.

7. The driving assembly according to claim 6, wherein an opening is formed in a part of the case, and at least a part of the gear portion is exposed through the opening so as to be gear-connected to the driving plate.

8. The driving assembly according to claim 6, wherein a first case and a second case are detachably coupled to each other.

9. The driving assembly according to claim 8, wherein at least one latching end is formed on the outer surface of the first case, and at least one latching hook is formed on the outer surface of the second case.

10. The driving assembly according to claim 6, the gear portion comprises at least one reduction gear; and a dependent gear for gear-connecting to the driving plate.

11. The driving assembly according to claim 10, the gear portion comprises a connection release member for releasing a gear connection between the driving plate and the dependent gear.

12. The driving assembly according to claim 11, wherein the connection release member comprises: a rotary shaft extending in one direction of the dependent gear;

a spring inserted into the rotary shaft; and a worm gear elastically supported by the spring and mounted to an end of the rotary shaft.

* * * * *